United States Patent [19]

Loveland et al.

[11] 4,041,675

[45] Aug. 16, 1977

[54] CARTON SEALING MACHINE CARTON SETTING UP AND LOADING EQUIPMENT

[75] Inventors: Winton Loveland, Fort Salonga; Horst J. Hanemann, Manhasset, both of N.Y.

[73] Assignee: The Loveshaw Corporation, Deer Park, N.Y.

[21] Appl. No.: 693,200

[22] Filed: June 7, 1976

[51] Int. Cl.[2] ..... B65B 57/00; B65B 7/20

[52] U.S. Cl. ..... 53/76; 53/374

[58] Field of Search ..... 53/75, 76, 374

[56] References Cited

U.S. PATENT DOCUMENTS

| | | | |
|---|---|---|---|
| 3,690,222 | 9/1972 | Schroeder | 53/374 X |
| 3,769,777 | 11/1973 | Miller et al. | 53/374 X |

*Primary Examiner*—Travis S. McGehee

*Attorney, Agent, or Firm*—Watson, Leavenworth, Kelton & Taggart

[57] ABSTRACT

Carton setting up and loading machine to facilitate an operator successively setting up in empty chamber-defining shape a plurality of cartons in upright position on their flat stack of bottom closing flaps folded inward and the loading of their chambers to release them to remainder of the machine for sealing of their tops and bottoms. Lateral machine bed has an entrance end and a discharge end with transport means to move a loaded carton laterally forward along a path from the former end to the latter end while sealing closed at least the folded top flaps thereof. A carton setting up and loading lateral support or table top precedes the entrance end of the machine bed adjacent thereto. A pair of lateral and elongated, carton-clamping guide side rails flank opposite sides of the carton forward moving path at a moderate level above the transport means with these rails initially separated transversely an appreciable distance intended successively to receive freely therebetween any of a number of the cartons of widths less than this distance of separation. These guide rails have elongated entrance ends extending back from and preceding the entrance end of the machine bed and the transport means of the latter while overlapping a portion of the loading support. Means are provided to move at least one of the side guide rails inward toward the other to snug their elongated entrance ends against opposite sides of an intervening carton immediately preceding the entrance end of the machine while resting upon the loading support and with sufficient pressure to hold the carton temporarily firmly upright with its top open for loading of its chamber. Also means maintain the side guide rails in their relatively inward carton snugging and guiding positions when the loaded carton is transported forward from the loading table into the entrance end of the machine bed for engagement by the transport means to move this carton forward past closure sealing means to the discharge end. Powered means cause the side guide rails alternately to move inward to opposite sides of each unsealed carton for first holding it, thereafter guiding its advance, and then outward as the sealed carton is discharged from the machine. An elevating head has its level adjusted to the top of each advancing carton with this elevational adjustment being delayed until after the first holding action.

7 Claims, 6 Drawing Figures

FIG. 4
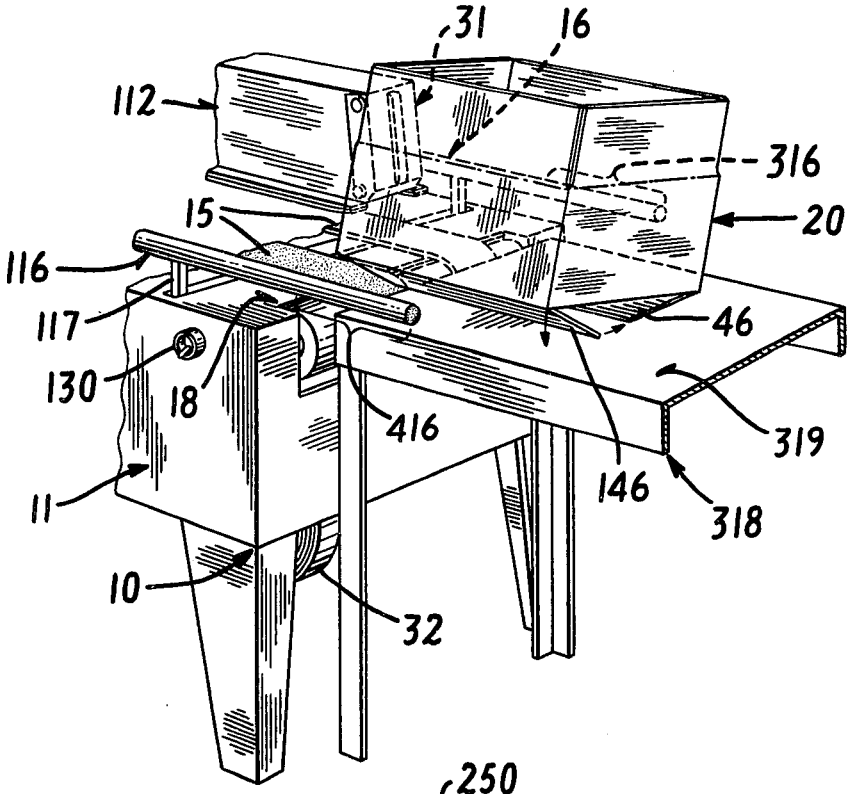
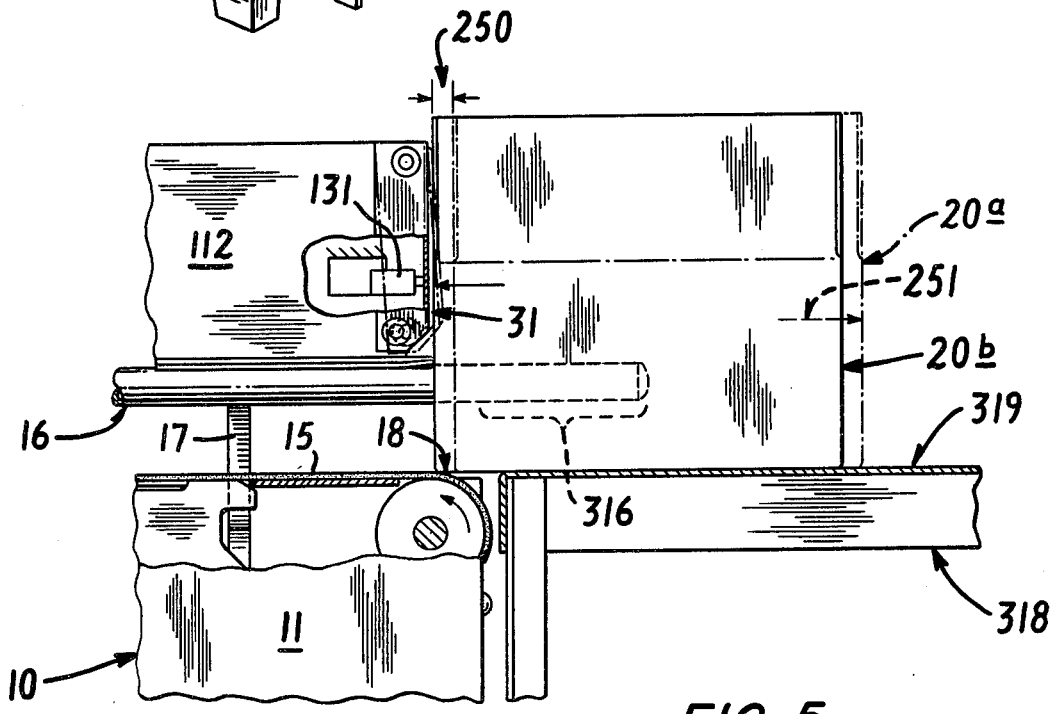
FIG. 5

CARTON SEALING MACHINE CARTON SETTING UP AND LOADING EQUIPMENT

BACKGROUND AND SUMMARY

The present invention is concerned with mechanism in a machine for sealing tops and bottoms of cartons including their infolded side and end flaps, after they have been loaded with contents for delivery, such sealing being selected from a variety of types of carton closures, e.g., stapling, gluing and applied adhesive tapes, preferably the latter, so as securely to anchor the folded top and bottom flaps. More specifically, the present invention is directed to a relatively simple but unusual solution of permitting an operator to set up a folded carton blank into an empty carton with its top flaps extending upward in open positions and with its bottom flaps infolded and firmly held down upon a loading support so that the operator may easily load the intended contents in the carton empty container, to be followed by a folding down of the top flaps to carton-closing positions and releasing the carton for transport through the machine so as to effect anchorage of the folded top and bottom flaps. Accordingly, it is preferred that such a machine include a lateral base structure and an elevator head structure with the latter supported on suitable vertical support structure for slidable up-and-down movement. Such a type of carton sealing machine is disclosed in the copending Warshaw et al. U.S.patent application Ser. No. 645,718 of Dec. 31, 1975 and Loveland et al. U.S. patent application Ser. No. 648,916 of Jan. 14, 1976, and the disclosures thereof are embodied herein by reference.

It is a general object of the present invention efficiently to embody in such a machine and its operating mechanisms relatively economical equipment which will demand minimum attention from the operator while the latter is engaged in loading the intended content of each carton into its empty chamber as the machine securely holds such carton automatically in a helpful upright position at a location where it is ready to be released immediately to the transporting equipment of the machine for progressive sealing of the carton top and bottom folded flaps.

Another object of the present invention is to employ in a unique and efficient manner side guide rails structure of such a machine for temporarily holding such carton in a proper upright position during the loading procedure while then after a simple command from the operator will serve as the usual pair of side guides for the transport movement of the loaded carton through the machine and past its sealing means applying equipment.

A more specific object of the present invention is to provide such side guide rails with elongated entrance ends which will lap along opposite sides of an open top carton that is being rested upon a lateral loading surface or table top and causing such side rails to move inward for snugging these elongated entrance ends against opposite sides of the carton for securely holding it in its desired upright position, whereby with such carton being located between the rail entrance ends it will automatically be in proper position for immediate forward movement between the guide rails through the machine.

A still further object of the present invention is to program the operating mechanisms of the machine whereby the inward movement of the side rails to their carton-clamping positions is effected prior to activation of the elevator head for raising it any appreciable amount above its initial lower position, so that this head is at the ideal location for start of processing of the loaded and clamped carton through the machine to subject it to the action of the sealing equipment.

In accordance with the present invention the sealing machine equipment is provided with motive power means to move the side clamping and guiding rails one toward the other for closer approach and alternately reversely outwardly away from the other for wide separation, with the elevating head being associated with motive power means to lift and lower it at will while locating it at a lower elevation upon energization of the machine mechanism. Control means on the approach end of the elevator head provides for engagement by a carton transported forward between the entrance ends of the guidance rails into the entrance end of the machine bed from a position on loading lateral support means preceding the machine entrance, such as a loading table top. This control means on the approach end of the head is of a character that when manipulated by a forwardly transported carton engaging thereagainst will lift the head above the elevation of the closed top of the advancing carton so that the latter may be advanced immediately below the head with the latter loading the folded top flaps constituting the temporary top closure of the carton until securement by sealing means which is to be applied thereto in the transport of the carton to the machine discharge end. The motive power means which manipulate the side rails and also the elevating head effect these functions in certain timed relation so that the side rails are moved inwardly for closer approach to snug a carton therebetween before lift is applied to the elevator head. For this purpose an energy operational and controlling circuitry is provided which includes the side rails and head motive power means and a suitable energy source to effect operational functionings thereof in an efficient manner. The equipment in such circuitry may be of a nature to be operated or driven by any one or more of suitable types of energy, e.g., electrical and/or pressurized gaseous medium, such as pneumatic equipment. It may be preferred that the rail driving and head elevating means, such as motors, be pneumatic cylinder motors with each separately connected to a common source of pressurized air through a separate one of a pair of control valves with each having a pressurized air manipulated valve member. Such control means on the approach end of the lowered elevator head may be provided with means dividing its pressurized air delivery for flow separately to one of the control valves with the divided flow to the driving rail control valve manipulating member being direct. In contrast to such direct flow to the manipulating member of the control valve for the driving rail action intermediate control valve means which intervene the lowered head control means and the head elevating control valve manipulating member imposes a greater time lag upon the initiation of the lifting of the head, whereby the earlier action of the inward motion of the side rails accomplishes the desired clamping of the empty carton in its loading position with an upright attitude most favorable to the loading operation prior to the ultimate desirable lift movement of the head and at a time when the loaded carton has had its top flaps folded inward into stacked relation for a flat top closure that will now allow the carton properly to be processed through the machine and past its sealing mechanisms.

Other objects of the invention will in part be obvious and will in part appear from reference to the following detailed description taken in connection with the accompanying drawings, wherein like numerals identify similar parts throughout, and in which:

FIG. 4 is a perspective view, with parts broken away and in section, showing a common position and condition of a carton blank after its bottom end and side flaps have been folded in and upward for closing the bottom of the carton chamber, indicating a tendency to cock to one side so as to interfere with the loading of the empty chamber thereof;

Figure 1:
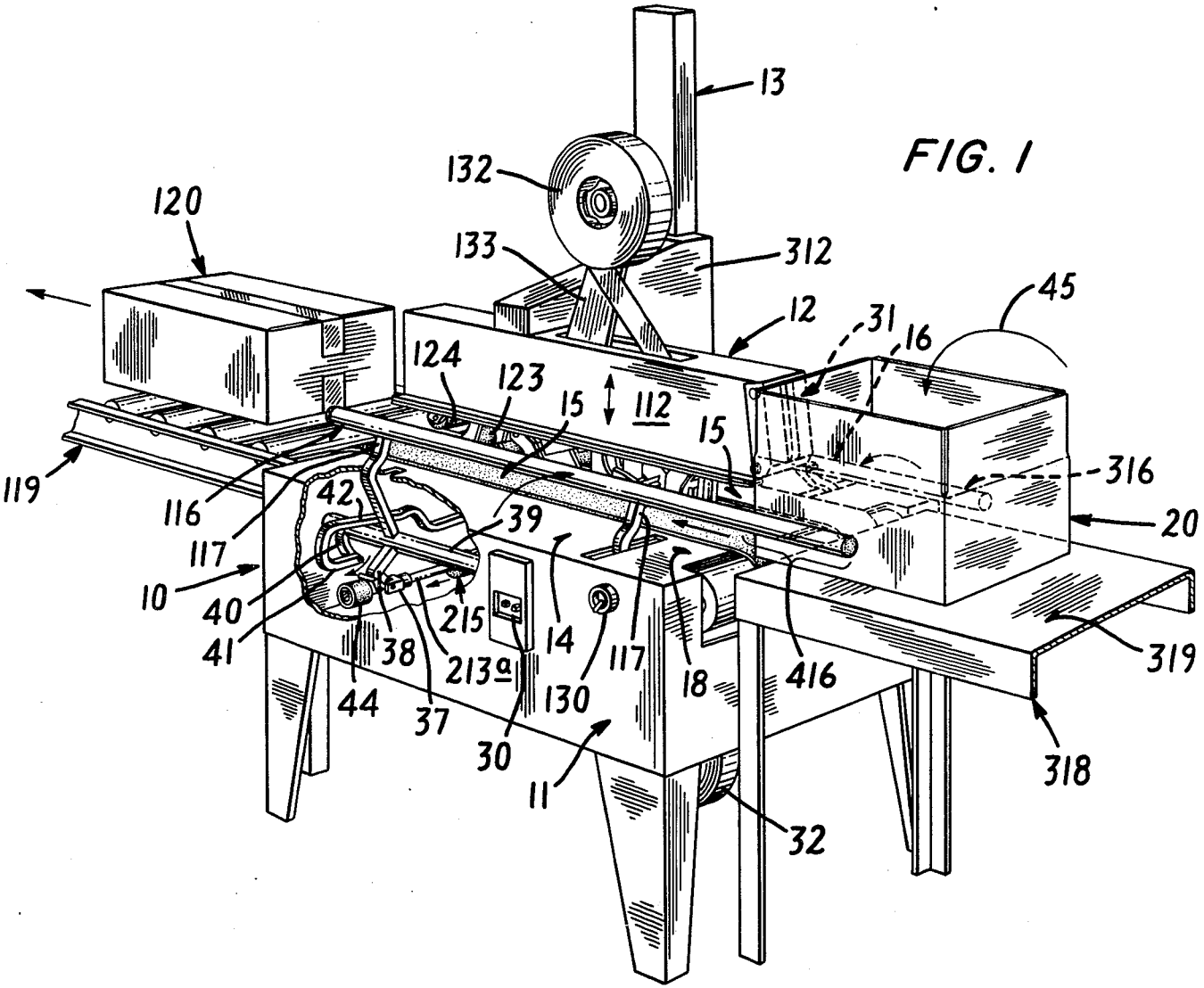
FIG. 1 is a perspective view, with parts broken away and in section, of a carton taping machine embodying the present invention and including a pair of separated side clamping and/or guiding rails and an elevator head with operating mechanisms and controls therefor.
Figure 6:
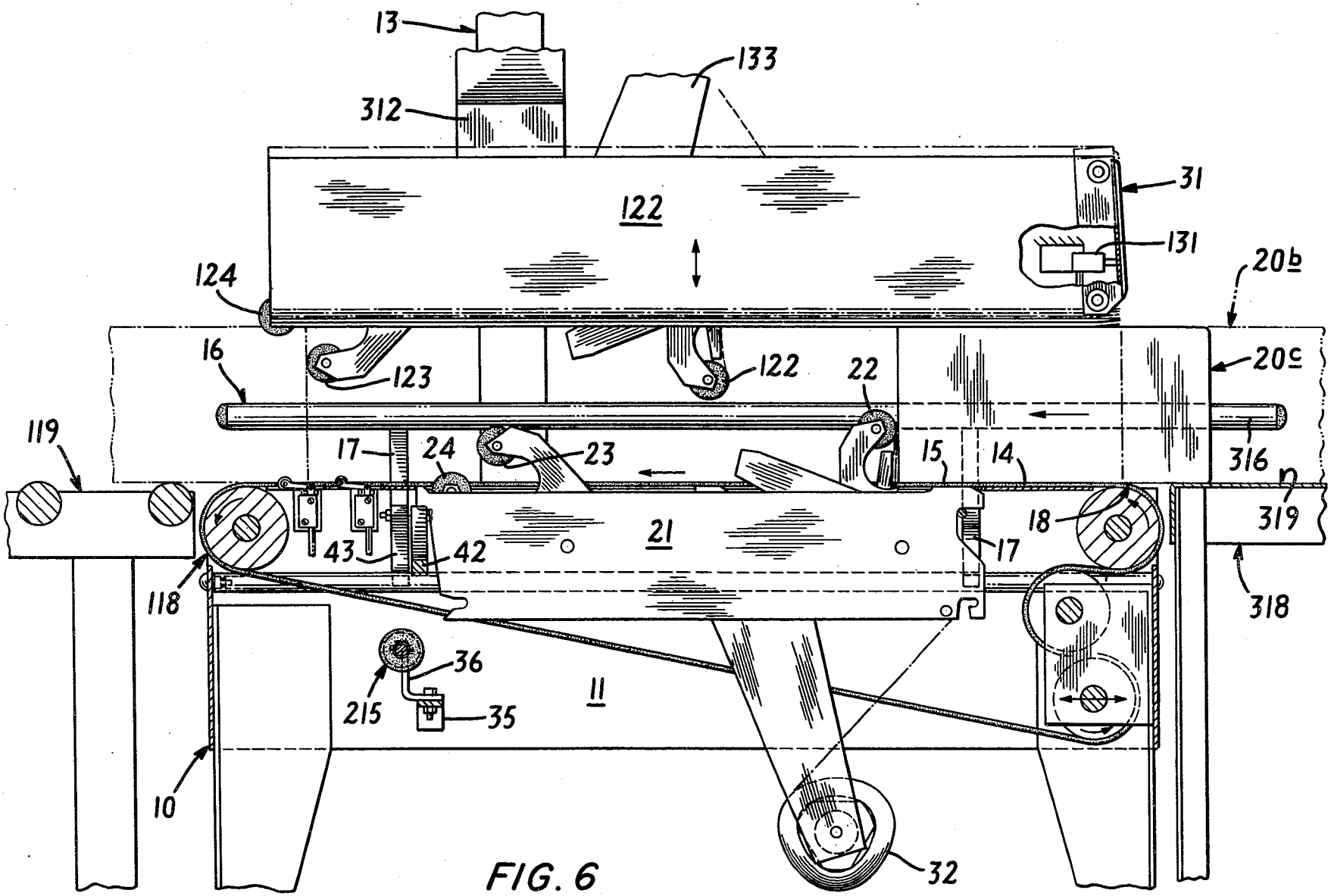

FIG. 5 is an enlarged elevational view, with parts broken away and in section, of the equipment and carton illustrated in FIG. 4 and depicting manipulation of the carton position to cause it to stand upright for easy loading due to clamping thereof between extended entry ends of the side clamping rails which overlap an exit section of the loading support or table top; and FIG. 6 is an enlarged longitudinal section, with parts broken away, of the machine of FIG. 1, illustrating the forward transport of a flap-closed loaded carton toward the discharge end of the latter.

The carton sealing machine 10 includes a lateral base structure 11 and an elevator head structure 12 with the latter supported, for slidable up-and-down movement, on a vertical column 13 that is mounted on the back side of the base structure.

The base structure 11 is provided with a substantially horizontal top panel 14 over which are driven the top runs of a pair of transversely-spaced, endless, carton-transporting belts 15. Above the base top panel 14 is supported a pair of longitudinally-extending carton-clamping side rails 16 and 116, with each suitably supported by upstanding arms 17 and 117 that are free to be moved transversely in slots in this top panel by equipment within the base structure which will cause the side rails to move alternatively and simultaneously and away from each other. Such side rail driving equipment may be any suitable powered means and preferably is of a certain construction that is illustrated in FIGS. 1 and 2 including a pneumatic cylinder motor 215 connected to the support structure of one of these side rails for moving it inward and outward sideways, and with the opposed side rail support structure being connected thereto by suitable linkage.

Such side rail driving equipment may include to advantage a transverse brace 35 of the machine base structure 11 on which is supported a bracket 36 that in turn pivotally anchors the back end of the barrel of the pneumatic cylinder motor 215, with the piston rod 213*a* of the latter extending out of the opposite end of this cylinder and carrying a clevis 37 that is pivotally connected to a tongue on a rotary lever arm 38 suitably anchored to a rotatable support rod 39 having its ends pivotally supported by the end walls of ths base structure 11. The rotary support rod 39 has fixed thereto the upstanding arms 117 for swing thereby in rotation to carry therewith, alternately inward and outward, clamping rail 116. FIGS. 1 and 2 together illustrate that rotary rod 39 has fixed thereto a crank arm 40 which is pivotally connected hooked end 41 of a reach 42 extending transversely to pivotal connection with a lever arm 43 fixedly carried by one of the upstanding arms 17 that carry the opposed longitudinal clamping guidance rail 16. It will also be seen that the bottom ends of the upstanding arms 17 which support this rail 16 are fixedly carried by another rotary support rod 139 also pivotally in similar manner. The lever arm 38 in the outward swing of the bottom end of the latter which is pivotally connected to the clevis 37 is adapted to be limited in its swing by a bumper 44 fixedly supported on the inner side of an upright sidewall of the base structure 11. Thus, when the pneumatic cylinder motor 215 thrusts its piston rod 213*a* outward the opposed side clamping and guide rails 16 and 116 are caused to be swung transversely toward each other, and when this piston rod is retracted these side rails swing outward away from each other to provide an intervening space which will readily receive therein a loaded carton to be processed through the machine.

Figure 2:
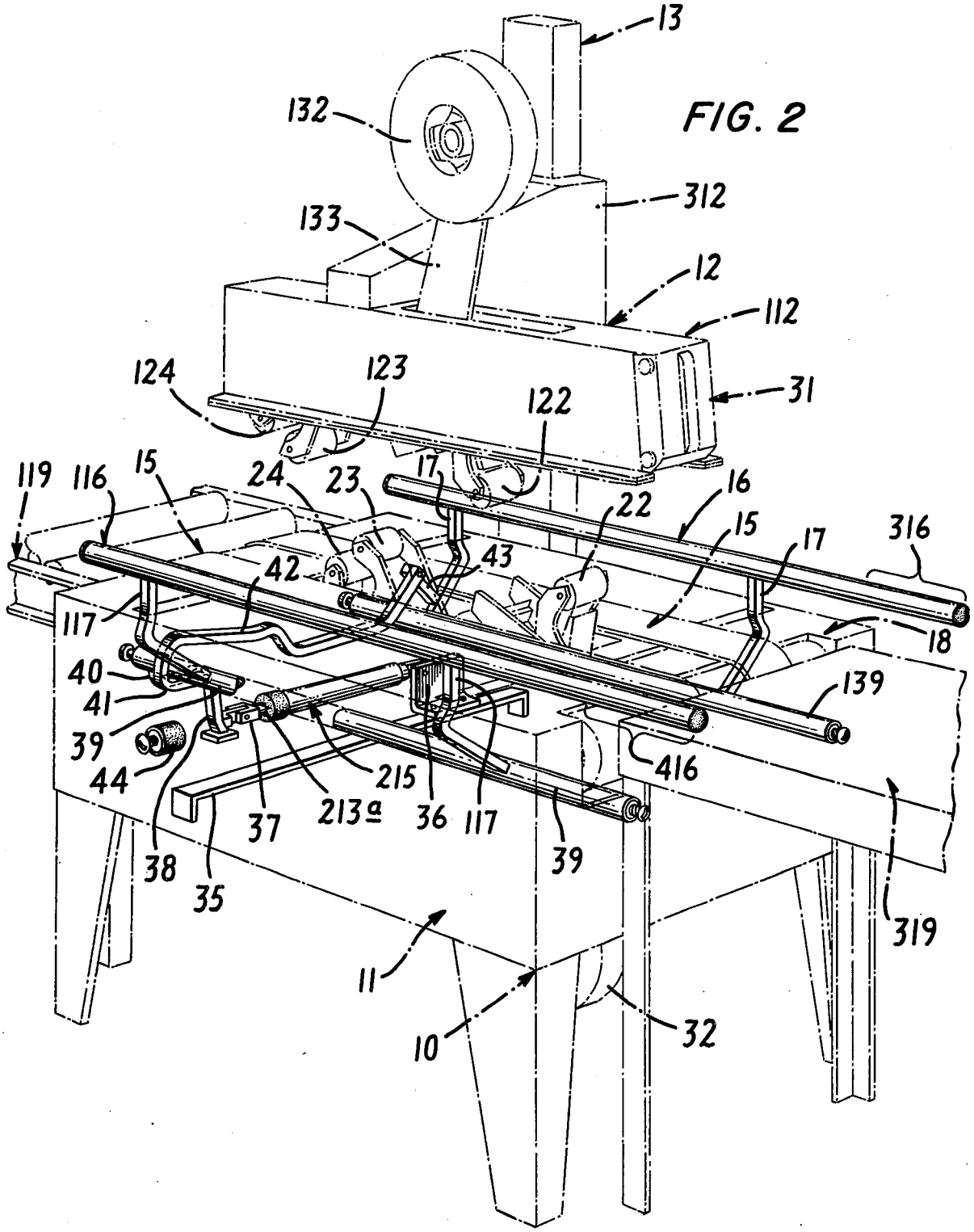
FIG. 2 is a phantom perspective view of the machine of FIG. 1, showing in full lines the pair of separated side clamping and guiding rails and the mechanism which move them alternately inward toward each other and outward away from each other.

It will also be noted from FIGS. 1 and 2 that the entrance ends of these cooperative side guide and clamping rails 16 and 116 are provided with extended entrance end sections 316 and 416 which overhang the exit end section of the lateral loading support or table top 319, so that when these end sections are moved in toward each other to opposite sides of the intervening open top carton 20 with snugging engagement thereof this carton will be firmly clamped in upright position therebetween immediately preceding the entrance end 18 of the machine base 11, and with the flaps of the top of the carton extending upward in open position so that the intended load may be placed into the carton chamber as is graphically indicated by the curved arrow 45 in FIG. 1.

As will be seen from FIGS. 2 and 6, between the laterally-spaced top runs of the pair of transporting belts 15 the central zone of the machine bed 11 is cut away or provided with a longitudinal slot into which a tape applying mechanism cartridge 21 is inserted downward for suitable removable anchorage in a position to expose above the top panel 14 in its three cylindrical wipe-on or applicator rollers 22, 23 and 24 for successive engagement by and application of tape to the lower sections of the end panels of the loaded carton 20 and its bottom closing stack of infolded end and side flaps as this carton is transported forward by the endless transporting belts 15. The head beam 112 is equipped with a similar tape applying mechanism cartridge which differs only in that it is oriented upside down whereby its tape applying rollers 122, 123 and 124 depend therefrom for successive engagement by and application of tape to the upper sections of the end panels of the loaded carton and its top closing stack of infolded end and side flaps.

Upon activation of the mechanism of the carton sealing machine illustrated herein and in the companion copending application of the applicants' patent application Ser. No. 648,916, filed Jan. 14, 1976, and entitled "Control Mechanism for Carton Sealing Machine Elevator Head", the elevator head 12 will be at its lowest elevation, such as for example, in a position so that a hinged end panel 31 that is carried by the approach end of the lateral beam 112 thereof may be abutted by the leading end wall of an oncoming carton fed off of the loading table support surface 319 forward into the entrance end 18 of the machine base 11. The rearward swing of this hinged end panel 31 will, as may be understood particularly from FIG. 4, manipulate by depression a pneumatic valve operator 131 as is indicated in the pneumatic circuitry diagrammatically shown in FIG. 3 as the "PADDLE" valve (LV1). Certain manipulation of this valve operator 131, such as prolonged depression thereof, causes the head beam 112 to be raised clear of the top of any such oncoming carton until this hinged end panel control 31 is freed for stopping the rise of the head beam at the top of such forwardly traveling carton. In this manner the head beam 112 is cleared from the path of the oncoming carton and is then permitted to rest down upon or load the top thereof during its forward travel through the machine so that manipulative action of the application of sealing tape, drawn from bottom and top supply rolls 32 and 132, to the leading and trailing end walls and to the bottom and top of the carton as defined by the infolded end and side flaps thereof may be carried out efficiently. Reference to the schematic layout of the pneumatic circuitry and mechanism mounted on and housed in the machine base 11 and the elevating head 12 may be understood by reference to FIG. 3 hereinafter explained in detail.

As is illustrated in FIG. 4 when a flap folded carton blank is set up by an operator of the machine, and its bottom end and side flaps infolded upward, there is a tendency for such bottom side flaps 46 and 146 to spring outward or downward to oblique positions, whereby the empty carton with its top flaps extending upward in open positions is canted to one side by resting upon the outer face of one of such oblique side flaps. This interferes with easy and efficient loading of the empty carton chamber and it is very desirable that the carton be moved down forcefully for re-upfolding such bottom side flaps into a common transverse plane for upright disposition of the side and end walls of the carton, as is illustrated in FIG. 1. This is accomplished by the operator pushing downward on the carton structure to reorient it to the FIG. 1 position while causing the side guide rails 16 and1 116 to be moved inward toward each other for lapping their elongated entrance ends 316 and 416 against the opposite sidewalls of the now properly upstanding empty carton. This snugging of these entrance end sections of the side rails to the opposite sides of the empty carton clamp it in the upright position of FIG. 1 so that the operator may freely load its empty chamber in an efficient manner, as is diagrammatically indicated by the curved arrow 45. The next step in the operation of the taping machine is to then fold down the top end flaps and follow this with a folding down of the top side flaps thereover for feeding such temporarily closed loaded carton into the entrance end 18 of the machine base 11 for transport to the discharge end past the tape applying top and bottom mechanisms for sealing such folded bottom and top flaps to produce the sealed loaded case 120.

Figure 3:
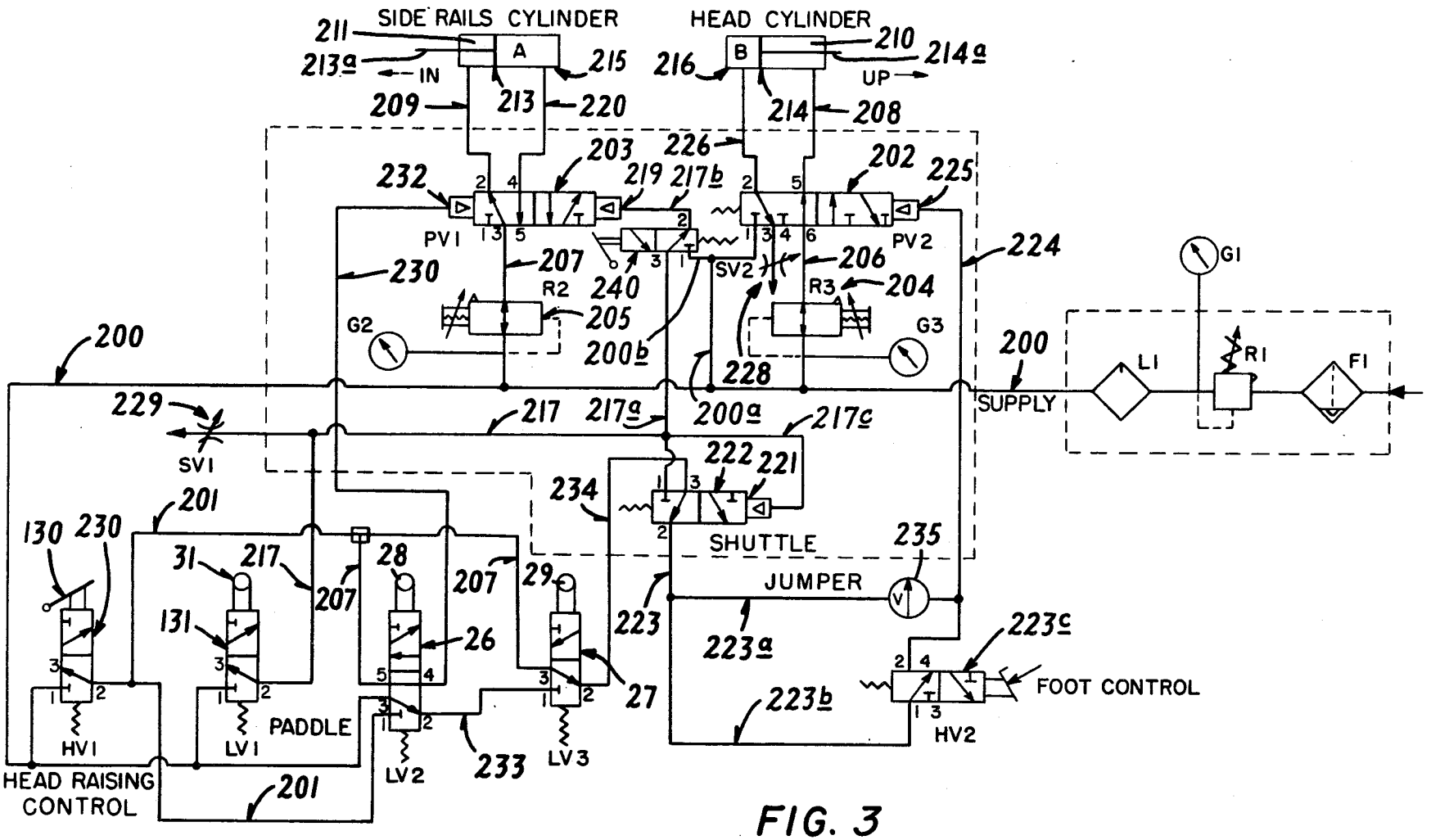
FIG. 3 is a schematic layout of the pneumatic circuitry embodying the present invention and equipment of the taping machine of FIGS. 1 and 2 which are manipulated by the operation of the equipment in the pneumatic circuitry.

The manipulation of the clamping side guide rails 16 and 116 to the inward positions of FIG. 1 is to be effected without undue raising of the head beam 112, since it is desirable that the paddle control valve 131 and its contacted depressible operator 31 are to be in the path of the leading carton end wall as this carton is transported forward for a proper raising of the head beam 112 just to above the level of the flap infolded closed top of the carton, so as to rest down thereon while the carton is transported forward for proper loading of such infolded flaps for assuring efficient application of the sealing tapes. Such manipulations of the side guide rails toward each other to effect the carton side snugging clamping action may be effected in a variety of ways as will be readily understood after the general operation of the pneumatic circuitry of FIG. 3 is made clear.

Assume that it is desired to run the tape applying machine 10 for successively processing therethrough a loaded carton, shown by way of example at 20, after its top flaps are folded down by the operator by hand and fed into the machine entrance 18 for pick-up by the pair of traveling endless bed belts 15. For this purpose the manually controlled, head raising shifter value 230 (HV1) on the entrance end of the machine bed structure 11 will be set manually by its trigger 130 (FIG. 1) in a position that prevents, i.e., does not allow, pressurized air in "SUPPLY" conduit 200, which is connected to its shifter side port No. 1, to flow across the core of this valve to its side port No. 2 and thence out through conduit 201 connected to the latter.

There is a flow path for conduction of pressurized air from "SUPPLY" conduit 200 to the Head Cylinder shifter valve 202 (PV2) and Side Rails shifter valve 203 (PV1) only through pressure regulators 204 (R3) and 205 (R2) respectively. Pressurized air will flow through conduit 206 from regulator 204 to side port No. 6 of head shifter valve 202 and across its core to side port No. 5 for flow through conduit 208 into the chamber 210 on the thrust rod side of the thrust head 214 in the motive power Head Cylinder 216, so as to lower, if up, and in any case hold down the machine head 12. At this same time pressurized air flows from regulator 205 (R2) through conduit 207 to side port No. 3 of side rails shifter valve 203 (PV1) and across its core to side port No. 2 for flow through conduit 209 into the chamber 211 on the thrust rod side of the thrust head 213 in the motive power Side Rails Cylinder 215, so as to spread and temporarily hold spreaded the side rails 16 and 116 for reception of a loaded carton therebetwen.

The processing of each single loaded carton through this taping machine as the operator pushes it forward, with its top flaps folded down in lapped closing position, to between widely spread entrance ends of the side rails may be described as follows. The carton enters the machine and abuts the pivoted paddle 31 on the approach end of the head beam 112 that is in its lowest position, so as to press back this pivoted paddle for depressing the spring biased core of the shifter valve 131 therebehind (FIG. 3) and hold it depressed. At this time the main pressurized air from "SUPPLY" line 200 flows from side port No. 1 to side port No. 2 (now connected thereto) of the core of shifter valve 131 and also flows along conduit 217 and its sections **217*a* and 217*b* to a (PV1) pilot valve end port 219, which will shift back from the latter the core of valve 203 (PV1) to connect to the pressurized "SUPPLY" line 200 through pressure regulator 205 (R2) and now interconnected side ports No. 3 and No. 4 of valve 203 and on through conduit 220 to the Side Rails Cylinder end chamber "A" so as to cause the thrust of its piston head 213 and rod 213*a* to close the side rails 16 and 116 toward each other for guidance contact of opposite sides of the forwardly traveling intervening carton. The core of valve 203 (PV1) will remain in this shifted position with interconnection of its side ports No. 3 and No. 4 until its core is shifted forward in the opposite direction to its original position shown in FIG. 4 by feed of pressurized air to its opposite pilot valve end port 232. Thus pressurized air is supplied from conduit 200 through regulator 205 (R2) conduit 207, across the shifted core of valve 203 from side port No. 3 to side port No. 4 and conduit 220 into chamber "A" so as to maintain pressurized biasing force on piston head 213** and the consequential inward pressure of the side rails throughout the passage of the carton along the machine bed from its entrance end to its discharge end.

This pressurized air also flows through branch conduit 217*c* to pilot end port 221 of "SHUTTLE" valve 222 which will move its valve core back against forward spring biasing so as to allow the pressurized air to flow across this core from its side port No. 1 to its side port No. 2. This pressurized air also flows through the air conduits 223, jumper 223*a* (with valve 235 in the latter open) and 224 to the pilot port 225 of the Head Cylinder valve 202 (PV2), which will shift the core of this valve back against its spring biasing to allow the pressurized air to flow from port No. 1 to port No. 2 thereof and through conduit 226 to the chamber "B" behind the piston head 214 of this Head Cylinder valve. Consequently this head pushes its thrust rod 214*a* and the head beam 112 carried thereby up to the point where the paddle operator 31 of shifting valve 131 (LV1) is raised from contact with the leading end of the carton whereby this paddle and this valve core are freed so that the latter is spring returned to its original position shown in FIG. 4. It may be desired to parallel jumper 223*a* with its valve 235 closed, so flow therethrough will be blocked, by another conduit 223*b* in which is connected a shiftable core valve 223*c* having its spring biased core in a normal position of flow blockage and equipped with a foot pedal to shift it to open position and so hold it by continued depression of its pedal.

As the core or shifter of paddle valve 131 (LV1) is raised with the head beam 112 above contact with the top edge zone of the leading end wall of the entering box and the paddle 31 is thus released for spring return to its original position, the air supply from side port No. 1 to side port No. 2 of the core of this (LV1) shifter valve is cut off so that the shifter core of the Head Cylinder valve 202 is returned by its spring biasing to its initial position, so as to shift connection of its side port No. 2 to its side port No. 3, for optional exhaust of Head Cylinder chamber "B" through a flow controlled bleed-off exhaust valve 228 (SV2). Thus the fluid or air pressure that has shifted the (PV2) valve core exhausts back through the "SHUTTLE" valve 22 and out of a flow controlled bleed-off exhaust valve 229 (SV1). This permits the head beam 112 to drop down by gravity force on the top of the carton as the carton begins to travel through the machine by means of the urging of the driven endless belts 15.

If desired, flow connections which may now be obvious may be added and employed either to supplement this gravity loading of the head structure down upon a carton top by some fluid or air pressure, or to offset some of it to lighten the head beam loading by suitable variance in the pneumatic circuitry. For example, the head beam 112 and the associated structure of head 12 may be caused to be lowered quickly downward to the top of the carton and apply a moderate pressure thereto. This is available by virtue of the fact that in Head Cylinder shifter valve 202 (PV2), upon spring return of its shifter core, the connection between side ports No. 1 and No. 2 is cut off and connection of side ports No. 2 and No. 3 is effected to exhaust chamber "B" of Head Cylinder 216. At this time the shifted core of Head Cylinder valve 202 (PV2) has connected side ports No. 5 and No. 6 to supply pressurized air through conduit 208 to the opposite side of the cylinder piston head 214 which accomplishes this desired operation.

One means for imposing delay in a raising of the machine head while the side rails are caused to be moved inward toward each other by feed of pressurized air to chamber "A" of the Side Rails Cylinder motor 215 for clamping the empty carton 20 in its broken line position 20*a* indicated in FIG. 5 (and also FIG. 1) may be that which is provided by the foot control 223*c* (HV2) in FIG. 3. With the Jumper valve 235 in the shown closed or blocking position and with the Foot Control valve 223*c* in the open position, as shown in FIG. 3, by virtue of pressure of the operator's foot upon the manual control pedal of this latter valve, no pressurized air will be delivered to the chamber "B" of the Head Cylinder motor 216 while pressurized air is being supplied to chamber "A" of the Side Rails Cylinder motor 215. This will provide the desired delay in activation of the powered lifting mechanism for the head. Such, or course, may demand application of depressing force to the foot pedal of the valve 223*c* (HV2), that may be considered by some to be rather restrictive of the movements of the operator while collecting and inserting the intended load into the empty carton chamber, as is indicated in FIG. 1. Of course, a releasable latch may serve to hold open this foot control valve 223*c,* if desired.

An alternative to the use of the Foot Control valve 223*c* may be insertion of a shiftable manual valve 240 inserted in the pressurized air supply line 217 between its branch sections 217*a* and 217*b* for feed of the pressurized air through such valve to the pilot 219 of the control valve 203 for the Side Rails Cylinder motor 215. As is indicated in FIG. 3 the core of this inserted valve 240 may be spring biased to through flow position therein shown, and manual shift of the core thereof against the spring biasing may be effected so as to connect the pressurized supply line 200 through branch lines 200*a* and 200*b* and across between side ports Nos. 1 and 2 for feed of the pressurized air through branch line 217*b* to the pilot 219 of control valve 203. A suitable latch may be employed to maintain such through flow condition to the Side Rails Cylinder motor 215 while the piston rod chamber of the Head Cylinder motor 216 is continued to be supplied with the pressurized air to keep the machine head down. This manual valve 240 may be provided with any suitable toggle operator manipulated by a pair of alternately operable push buttons, to maintain the shift thereof through a desired period.

A third way of providing delivery in manipulation of the motive power for raising the head cylinder while the side rails are moved laterally in toward each other to opposite sides of an intervening carton upon the loading surface or table top, by the Side Rails Cylinder motor 215, may be attained by utilization of control means on the approach end of the lowered head beam 112 to be engaged and manipulated by the operator or by the advance of the now loaded carton thereto and immediate withdrawal. It will be seen from FIG. 5 that if the empty carton is supported on the loading surface 319, in the broken line position 20*a*, between the widely separated entrance ends 316 and 416 of the side rails 16 and 116 the operator may cause the supplied pressurized air to be divided for flow separately to the respective control valves 202 and 203. The latter rail driving control valve 203 supplies a flow path through to the Side Rails Cylinder chamber "A" by shift of the core of such control valve 203 as a result of feed of pressurized air to the pilot 219 thereof as its manipulating member when the paddle valve 131 (LV1) has its control 31 depressed by contact from the carton as it may be moved forward to its full line position indicated at 20*b* in FIG. 5. With the Jumper valve 235 in through flow condition the head elevating control valve 202 will require for shift about the same time interval for connecting its side ports No. 1 and No. 2 together for feed of pressurized air from the supply line 200 to the Head Cylinder chamber "B", for raising the head. However, this cannot occur with respect to raising of the head until pressurized air supplied through the "PADDLE" valve 131 (LV1) to conduit section 217 and its successive branch 217*c* can have effected manipulation of the pilot 221 of the "SHUTTLE" valve 222 to shift its core against the spring biasing for flow connection onward to the pilot 225 of the head cylinder control valve 202. Thus the "SHUTTLE" valve and its time delay pilot 221 constitute an intermediate control valve intervening the lowered head control means, in the form of valve 202 (PV2) and its pilot 225 shifting of the core of PV2 for supply of pressurized air to chamber "B" of the Head Cylinder 216, all of which are more time consuming than the direct action of valve 203 and supply directly therethrough of pressurized air from the same source to chamber "A" of the Side Rails Cylinder 215. In view of these teachings it will now be apparent that many different means requiring time delaying manipulations may be employed to delay the raising of the head after the side rails have been moved in to snug to the opposite sides of the carton set up for loading on the support surface or loading table top.

Accordingly, the operator of the machine may set up in proper upright position the empty carton 20 in the broken line position 20*a* in FIG. 5, without the top flaps being folded down into stacked relation, and push it forward to advance its leading end wall through the distance 250 to the full line position of the carton 20*b* for depressing the hinged valve control 31 to manipulate the valve 131 thereby, and then immediately back up this unclosed carton along the broken line arrow 251 back approximately to the broken line starting position 20*a* as the lapping front entrance ends 316 and 416 of the side rails 16 and 116 are snugged into opposite sides of the empty carton to hold it for the loading operation. Thereafter, the operator folds down the top flaps into stacked relation and again advances the carton so that its leading end wall again depresses the "PADDLE" valve operator 31, for initiating the entry of the loading carton into the machine and its advance therethrough in the manner previously described. Such initiation of advance of the loaded and flap-closed carton is indicated in FIG. 6 at, for example, 20*c*, as it is being transported forward for sealing processing by the tape applying rollers 22, 23 and 24; and 122, 123 and 124.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

Having described out invention, what we claim as new and desire to secure by Letters Patent is the novel subjects matter defined in the following claims:

1. In a carton setting up and loading machine to facilitate an operator successively setting up in empty chamber-defining shape a plurality of cartons with their bottom closing flaps folded inward and loading their chambers to release them to the machine for sealing of their tops, comprising 1. a machine lateral bed having an entrance end and a discharge end with transport means laterally to move a loaded carton forward along a path from the former end to the latter end while sealing closed at least the folded top flaps thereof;
2. a carton setting up and loading lateral support preceding and adjacent to said entrance end of said machine bed;
3. a pair of substantially straight and parallel, laterally-extending and elongated, carton-clamping guidance side rails flanking opposite sides of the carton forward moving path to the discharge end and moderately elevated above said transport means with said rails initially separated transversely an appreciable distance intended successively to receive freely any of a number of the cartons of a width less than this distance of separation, said guidance rails having elongated entrance ends extending back from and preceding the entrance end of said machine bed and the transport means of the latter while overlapping a portion of said loading support;
4. means to move at least one of said side guidance rails inward toward the other to snug their entrance ends against opposite sides of an intervening one of the cartons immediately preceding the entrance end of the machine while resting upon said loading support and with sufficient pressure as to hold the carton temporarily firmly upright with its top open for loading of its chamber; and
5. means to maintain said side guidance rails in their relatively inward carton snugging and guiding positions when the loaded carton is transported from said loading table into the entrance end of said machine bed for engagement by said transport means to move it forward past closure sealing means to the discharge end.

2. In a carton setting up and loading machine to facilitate and operator successively setting up in empty chamber-defining shape a plurality of cartons with their bottom closing flaps folded inward and loading their chambers to release them to the machine for sealing of their tops, comprising 1. a machine lateral bed having an entrance end and a discharge end with transport means laterally to move a loaded carton forward along a path from the former end to the latter end while sealing closed at least the folded top flaps thereof;
2. a carton setting up and loading lateral support preceding and adjacent to said entrance end of said machine bed;
3. a pair of substantially parallel, laterally-extending elongated, carton-clamping guidance side rails flanking opposite sides of the carton forward moving path and moderately elevated above said transport means with said rails initially separated transversely an appreciable distance intended successively to receive freely any of a number of the cartons of a width less than this distance of separation, said guidance rails having elongated entrance ends extending back from and preceding the entrance end of said machine bed and the transport means of the latter while overlapping a portion of said loading support;

4. motive power means alternately to moveat least one of said side guidance rails inward toward the other to snug their entrance ends against opposite sides of an intervening one of the cartons immediately preceding the entrance end of the machine while resting upon said loading support and with sufficient pressure as to hold the carton temporarily firmly upright with its top open for loading of its chamber, and reversely outward away from the other for wide separation;
5. an elevating head having motive power means associated therewith to lift and lower it at will while locating it at a lower elevation upon energization of said machine, and control means on the approach end of said head engageable by a carton transported forward between the snugging entrance ends of said guidance rails into the entrance end of the machine bed from the loading lateral support; and
6. means to maintain said side guidance rails in their relatively inward carton snugging and guiding positions when the loaded carton is transported forward from said loading table into the entrance end of said machine bed for engagement by said transport means to move it forward past closure sealing means to the discharge end.

3. The carton setting up and loading machine defined in claim 2 characterized by said motive power means that is associated with said elevating head being adapted when said control means is manipulated by a forwardly transported carton engaging thereagainst to lift said head above the elevation of the top of the carton when closed, whereby this carton will advance below said head to the machine bed discharged end.

4. The carton setting up and loading machine defined in claim 3 characterized by said side rails moving motive power means and said head elevating motive power means being associated by means effecting certain timed relationship between their operations of said rails and head whereby said side rails are moved inwardly for closer approach to snug a carton therebetween before lift is applied to said head.

5. The carton setting up and loading machine defined in claim 4 characterized by said motive power means and said timing relationship means including an energy operational and controlling circuitry embodying the plurality of said rails and head motive power means and an energy source with intervening controlling means differing for said head motive power means and for said rail motive power means whereby the operation of the latter precedes that of the former.

6. The carton setting up and loading machine defined in claim 5 characterized by said energy operational and controlling circuitry being in the form of a pressurized gaseous medium source and system of conduits including valving controls and responsive driving motors with valving control means intervening a head elevating motor and said source and a rail driving motor and the latter, said elevating motor control means imposing upon the initiation of the drive of the elevating motor a greater time lag than that imposed by said rails driving motor control means upon the initiation of the operation of the rails driving motor.

7. The carton setting up and loading machine defined in claim 6 characterized by said rail driving and head elevating motor being pneumatic cylinder motors with each separately connected to a common source of pressurized air through a separate one of a pair of control valves each having a pressurized air manipulated valve member, said control means on the approach end of said lowered head having means dividing its pressurized air delivery for flow separately to one of said control valves with the divided flow to said driving rail control valve manipulating member being direct, and an intermediate control valve intervening the lowered head control means and the head elevating control valve manipulating member imposing the greater time lag upon the initiation of the lifting of said head:

* * * * *

UNITED STATES PATENT AND TRADEMARK OFFICE

CERTIFICATE OF CORRECTION

PATENT NO. : 4,041,675

DATED : August 16, 1977

INVENTOR(S) : Winton Loveland and Horst J. Hanemann

It is certified that error appears in the above-identified patent and that said Letters Patent are hereby corrected as shown below:

Column 1, line 20, for "container" read --chamber--. Column 3, line 53, for "simultaneously and" read --simultaneously toward and--. Column 4, line 3, for "ths" read --the--; line 8, for "40 which" read --40 to which--; line 50, for "in its" read --its--. Column 5, line 47, for "1 116" read --116--. Column 6, line 19, for "value" read --valve--; line 45, for "therebetwen" read --therebetween--. Column 7, line 58, for "on the top" read --on top--. Column 8, line 28, for "or" read --of--. Column 9, line 26, for "delay" read --delaying--; line 57, for "loading" read --loaded--. Column 10, line 4, for "out" read --our--; line 45, for "transported from" read --transported forward from--; line 51, for "and" read --an--. Column 11, line 9, for "moveat" read --move at--. Column 12, line 22, for "rail" read --rails--; line 43, for "head:" read --head.--.

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*